United States Patent [19]

Bar et al.

[11] Patent Number: 5,042,100

[45] Date of Patent: Aug. 27, 1991

[54] METHOD FOR PRODUCING AN INSOLE

[75] Inventors: Aharon Bar, Bronx, N.Y.; Michael Bar, Tenafly, N.J.

[73] Assignee: Orthofeet Inc., Hillsdale, N.J.

[21] Appl. No.: 449,974

[22] Filed: Dec. 12, 1989

[51] Int. Cl.[5] ..... A43B 13/38; B29B 15/10

[52] U.S. Cl. ..... 12/142N; 12/146 M; 264/223

[58] Field of Search ..... 12/142 N, 146 M; 264/223

[56] References Cited

U.S. PATENT DOCUMENTS

| | | | |
|---|---|---|---|
| 1,044,171 | 1/1910 | Guilford | 264/223 |
| 2,092,910 | 9/1937 | Daniels | 12/146 M |
| 2,136,815 | 11/1938 | FÖrster et al. | 12/142 N |
| 2,242,818 | 5/1941 | Donovan | 12/146 M |
| 4,385,024 | 5/1983 | Tansill | 264/22 |
| 4,470,782 | 9/1984 | Zimmerman, Jr. et al. | 264/223 |
| 4,520,581 | 6/1985 | Irwin et al. | 12/146 M |
| 4,813,090 | 3/1989 | Ibrahim | 12/142 N |
| 4,823,420 | 4/1989 | Bartneck | 12/146 M |

*Primary Examiner*—Jimmy G. Foster
*Assistant Examiner*—M. D. Patterson
*Attorney, Agent, or Firm*—Ladas & Parry

[57] ABSTRACT

A method and apparatus for producing an insole for a foot including defining a flexible insole housing in which is disposed a deformable material impregnated with an uncured resin, activating the resin for initiating curing thereof, locating the foot on the insole housing and allowing the resin to harden and thus, to preserve the configuration defined by the bottom of the foot.

13 Claims, 3 Drawing Sheets

METHOD FOR PRODUCING AN INSOLE

FIELD OF THE INVENTION

The present invention relates to insoles or inserts for shoes and to a method of producing them.

BACKGROUND OF THE INVENTION

An insole is an element inserted between a shoe and the foot to reduce local pressures in sensitive spots on the plantar surface of the foot so as to prevent or reduce pain and future damage to the foot and to the locomotor system. This is accomplished by fixing the foot in a certain position and orientation relative to the shoe, and by controlling the shape of the insole/foot interfacial surface.

Several types of insoles are widely marketed. For certain problems, a standard, pre-cut insole which can be mass produced in various shoe sizes and fit into conventional shoes suffices. However, individually tailored shoe inserts which are shaped to the individual foot are always preferable, especially in certain foot disorders. Such inserts are generally made by a process which is both laborious and time consuming. A plaster cast is taken of the affected foot and, using this cast, an insert of the proper size and shape is built by hand and fit into the shoe.

Other methods disclosed in the literature are less time consuming than this method being based on molding an insole inside the shoe. The first such method is a method of producing inserts for ordinary shop-bought or standard "deep shoes", disclosed by R. G. S. Platts, S. Knight and I. Jakins in an article entitled "Shoe inserts for small deformed feet", *Prosthetics and Orthotics International,* 1982, Vol. 6, pp. 108–110. This method involves molding the insert in the shoe either using the foot itself or a positive cast of the foot. The method includes preparing a shoe-shaped "polythene" bag, which is cut, sealed and heat shrunk onto a last of approximately appropriate size for the shoe, and preparing an insole base for stiffening. The insole base is placed in the polythene shoe bag and both are placed in the shoe. If using the patient's foot directly, the foot is clothed in stockinette and covered with a shaped sock made of Ambla P072 having a polyurethane film which is painted with a release agent where adhesion to the foam is not required. If using a cast, the cast is covered with a thin latex sheet.

The components of a flexible self-generating polyurethane foam are mixed and quickly poured into the polythene bag in the shoe. The foot or cast is placed in the shoe and the correct attitude is maintained for a further two minutes until the foam hardens. The patient should bear weight on the foot.

Once the foam has hardened, the foot and the polythene bag are removed from the shoe and the insert is trimmed as necessary. A layer of preformed polyurethane foam is added to complete the insert.

It is a disadvantage of this method that the uncontrolled pressure created within the shoe during molding causes a change in foot shape and placement relative to the shoe. The method is also relatively laborious and time consuming.

A second method of preparing an insole inside the shoe is disclosed in U.S. Pat. No. 3,895,405. This method comprises placing a flexible foam insole member into a shoe, heating the insole to a temperature sufficient to cause the foam to lose some of its resiliency, placing a foot in the shoe before the insole regains its resiliency, and taking steps with the foot in the shoe until the insole regains its resiliency.

This method suffers from the difficulty of obtaining the desired height of the insole by the molding process itself, thus requiring additional steps of trimming or adding layers to the insole, which lengthen the process of insole production. Furthermore, thermoplastic foam materials tend to deform and lose their original shape after a short period of time.

U.S. Pat. No. 4,128,951 to Tansill describes an insole which includes outer and inner containers. The inner container holds a quantity of liquid catalyst, while the remainder of the interior of the outer container is filled with a curable liquid elastomeric material. In the technique of insole configuration, the inner container is rendered frangible and then the outer container is compressed to rupture the inner container, producing contact between the catalyst and the curable liquid elastomeric material.

A principle disadvantage of the method described above is that the insole is filled with premeasured quantities of materials, notwithstanding the fact that every foot has a different shape and thus requires an insole of different shape and containing a different volume of such materials. If the premeasured quantity of materials does not fill the space between the shoe and the foot, the insole does not conform to the foot. Moreover, if the premeasured quantity of materials exceeds the space between the shoe and the foot, the insole will become too thick and create excessive pressure on the foot.

Tansill suggests a solution for the above problem in U.S. Pat. No. 4,385,024. In that patent, he describes a method for measuring the amount of elastomeric material for each individual foot, employing special equipment. This method is cumbersome, expensive and time consuming.

In U.S. Pat. No. 4,272,898, Tansill describes a shoe insert comprising a mass of fibers which are coated with a curable resin and other fibers which are hollow and contain a curing agent. This proposal is relatively complicated and expensive for the following reasons:

1. It is difficult to fabricate the insert structure to have the hollow fibers uniformly dispersed among the coated fibers.

2. The material of the hollow fibers is required to serve initially as a barrier separating the curing agent and its vapors from the curable material and its vapors and later to be rendered frangible such that it allows a uniform release of the curing agent on the coated fibers. Tansill does not suggest suitable materials for making the hollow fibers.

3. The proposed technique of rendering the hollow fibers frangible requires special equipment and treatments.

Applicant's U.S. Pat. No. 4,716,662 describes a simple and fast method for production of shoe insoles which permits the precise control of the insole being produced. U.S. Pat. No. 4,716,662 teaches a method for casting in situ an insole on a foot comprising the steps of preparing a mold, defining an open top recess, providing a casting material in the recess, placing the foot inside the recess at a predetermined angle and position relative to the mold, engaging the casting material by the plantar surface of the foot, permitting the casting material to conform to the shape of the plantar surface of the foot, and permitting the casting material to harden.

SUMMARY OF THE INVENTION

It is an object of the present invention to provide apparatus and a technique for custom forming an insole inside the shoe.

There is thus provided in accordance with a preferred embodiment of the present invention a method for producing an insole for a foot including the steps of defining an insole housing in which is disposed a deformable material impregnated with an uncured resin, injecting a curing agent into the insole housing to activate the resin and to start curing thereof, locating the foot on the insole housing, and allowing the resin to harden and to preserve the configuration defined by the bottom of the foot..

There is also provided in accordance with a further preferred embodiment of the present invention a method for producing an insole for a foot including the steps of defining an insole housing in which is disposed a deformable material impregnated with an uncured resin, allowing water vapor contained in the atmosphere to penetrate the insole housing to activate the resin and to start curing thereof, locating the foot on the insole housing, and allowing the resin to harden and to preserve the configuration defined by the bottom of the foot.

There is further provided in accordance with still a further preferred embodiment of the present invention a method for producing an insole for a foot including the steps of defining an insole housing in which is disposed a deformable material impregnated with an uncured resin, disposing in the housing a container containing a curing agent, forming at least one opening in the container, allowing the curing agent to escape via the at least one opening, to contact the resin and to activate the resin, locating the foot on the insole housing, and allowing the resin to harden and preserve the configuration defined by the bottom of the foot.

Further in accordance with a preferred embodiment of the present invention, the forming step includes the step of puncturing the container.

Still further in accordance with a preferred embodiment of the present invention, the curing agent is maintained under pressure in the container.

Additionally in accordance with a preferred embodiment of the present invention, the at least one opening is formed in the container by application of external pressure.

Further in accordance with a preferred embodiment of the present invention, the application of external pressure is provided by a patient stepping onto the insole housing.

Still further in accordance with a preferred embodiment of the present invention, the step of defining also includes the step of wrapping an elongate member around the container and extending the elongate member outside the insole housing and wherein the step of forming includes the step of rupturing the container by pulling the elongate member.

Additionally in accordance with a preferred embodiment of the present invention, the container and a portion of the elongate member, located within the insole housing, are contained within another container whose upper layer is perforated.

Further in accordance with a preferred embodiment of the present invention, the resin includes a moisture cured prepolymer polyurethane.

Still further in accordance with a preferred embodiment of the present invention, the method also includes the step of storing the insole housing in a moisture impermeable storage enclosure.

Additionally in accordance with a preferred embodiment of the present invention, the method also includes the step of defining at least one opening in the insole housing, for allowing resin curing reaction products to escape therethrough.

Further in accordance with a preferred embodiment of the present invention, the resin includes polyurethane resin.

Still further in accordance with a preferred embodiment of the present invention, the method also includes the step of inserting the insole into a shoe.

Additionally in accordance with a preferred embodiment of the present invention, the step of defining includes the step of integrally forming the insole within a shoe.

Still further in accordance with a preferred embodiment of the present invention, the curing agent includes a protic compound.

Additionally in accordance with a preferred embodiment of the present invention, the deformable material includes reticulated polyurethane foam.

Further in accordance with a preferred embodiment of the present invention, the resin, when activated, expands into spaces defined by cells of the deformable material.

According to still another preferred embodiment of the present invention, there is provided apparatus for producing a custom made insole including an insole housing having a selectable shape, a deformable material located within the insole housing, and means for selectably hardening the deformable material following desired configuration thereof by engagement with a foot.

Further in accordance with a preferred embodiment of the present invention, the insole housing is selectably locatable in a shoe.

Still further in accordance with a preferred embodiment of the present invention, the insole is integrally formed with a shoe.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS OF THE INVENTION

Figure 1:
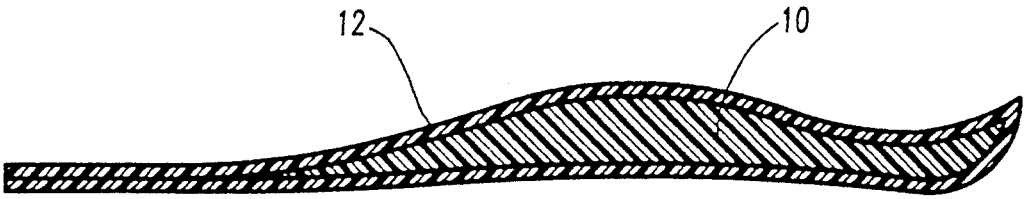
FIG. 1 is a sectional illustration of an insole constructed and operative in accordance with an embodiment of the invention.

Reference is now made to FIG. 1 which illustrates an insole constructed and operative in accordance with a preferred embodiment of the present invention. A flexible insole housing 12 has the general configuration of the inner sole of the shoe. It can be fitted inside the shoe, and can preferably be transferred from one shoe to another. Examples of materials for the insole housing are polyethylene foam, polyethylene film, polyurethane foam, rubber foam and leather.

According to an alternative embodiment of the invention, the insole housing is integrally fomed with the shoe, allowing the foot to engage the upper layer of the insole housing.

According to a preferred embodiment of the invention, the insole housing 12 is filled with a deformable material 10 such as open-cell cellular material or a matrix of fibers, as described hereinafter. The pressure engagement of the foot on the deformable material defines its desired shape. This shape is later fixed by a curing step.

According to a preferred embodiment of the present invention, the deformable material is a reticulated polyurethane foam, such as is widely used for air-conditioning filters and is available in various densities for various levels of resiliency from Crest Foam, Inc. of Moonachie, N.J., U.S.A., under the designation RO-20. This material has large open cells which allow easy penetration of the curing agent and contact therewith.

According to a preferred embodiment of the present invention, the deformable material is impregnated with a material that can harden and preserve the shape defined by the bottom of the foot. The impregnated material is typically an unactivated resin which is activated by a curing agent before or when the foot is placed on top of the insole housing. An example of such impregnating material is a moisture cure polyurethane prepolymer, such as Hypol FHP 4000, commercially available from WR Grace of Lexington, Mass. This prepolymer reacts with a curing agent such as a protic (active hydrogen containing) compound to form elastomeric foams. Examples of protic compounds include hydroxyl groups, e.g. water, alcohols, polyols and phenols; primary and secondary amino groups; and carboxylic acid groups. When water is used as the curing agent, carbon dioxide may be produced as a by-product of the reaction.

An advantage in using a moisture cure polyurethane instead of two-component polyurethane lies in the fact that the moisture cure polyurethane cures even when it is not well mixed with a curing agent and can also be cured by the moisture contained in the air.

According to a preferred embodiment of the present invention, the curing agent is injected into the insole.

Figure 2:
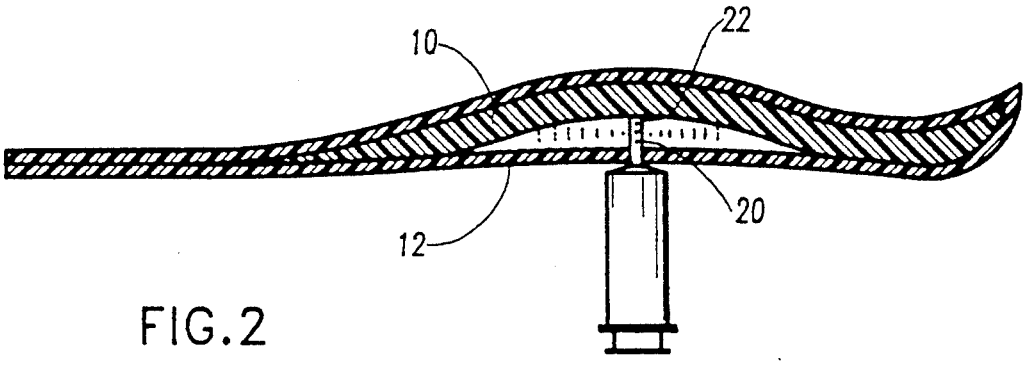
FIG. 2 is a sectional illustration of the insole of FIG. 1 with an associated syringe supplying curing agent thereto.

According to a preferred embodiment of the present invention, illustrated in FIG. 2, the curing agent is injected via a syringe tip 20 which penetrates into the insole housing 12. An array of small holes 22 is defined on the tip, to allow effective and uniform dispersion of the curing agent within the entire insole housing. In the illustrated embodiment of FIG. 2, the syringe pushes up the deformable material 10, allowing the curing agent to come into contact with most of the deformable material for curing thereof. After injection, the hole in the insole housing 12 may be closed as by use of a substantially moisture impermeable laminated film which may comprise a combination of 0.002 inch polypropylene film, 0.001 inch aluminum foil and a pressure sensitive adhesive.

Figure 3:
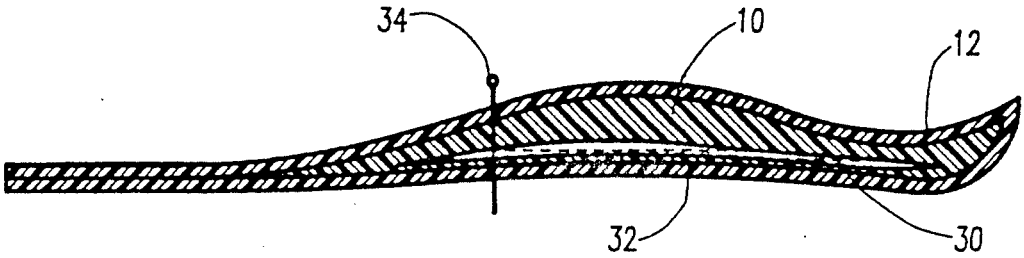
FIG. 3 is a sectional illustration of another type of insole constructed and operative in accordance with the present invention.

According to a further embodiment of the present invention, illustrated in FIG. 3, a curing agent 30 is contained in a container 32 located inside the insole housing 12. Prior to use, at least one opening is defined in the container 32 to release the curing agent. As illustrated in FIG. 3, the opening may be produced by puncturing the container 32 by means of a sharp element 34, such as a needle, pin or push-pin, to form at least one opening in the container and to release the curing agent.

Alternatively, an opening in container 32 may be produced by applying external pressure to the container. Such pressure may be applied by a person's foot when the person steps on the insole housing.

According to the further embodiment of the invention, the pressure inside container 32 is maintained slightly below the level that can cause an opening in or breakage of the container. This enables an opening to be formed in container 32 by application thereto of only a relatively small amount of external pressure.

Figure 4:
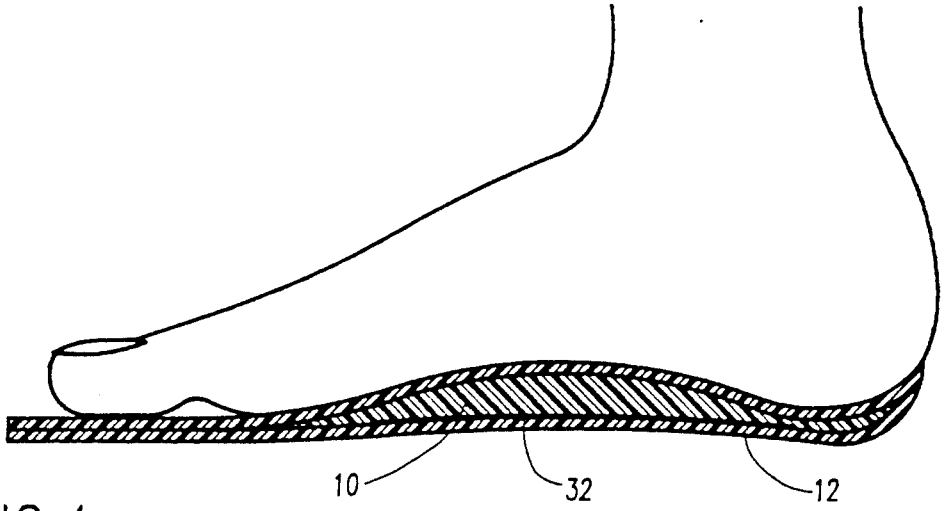
FIG. 4 is a sectional illustration of the insole of FIG. 3 after release of the curing agent, in engagement with a foot for curing in accordance with the foot configuration.

FIG. 4 illustrates the embodiment of FIG. 3 after the curing agent 30 has been released from container 32 and container 32 has been effectively flattened, as shown. The resin is permitted to harden while the foot engages the insole in order to configure the insole in accordance with the foot configuration.

Figure 5:
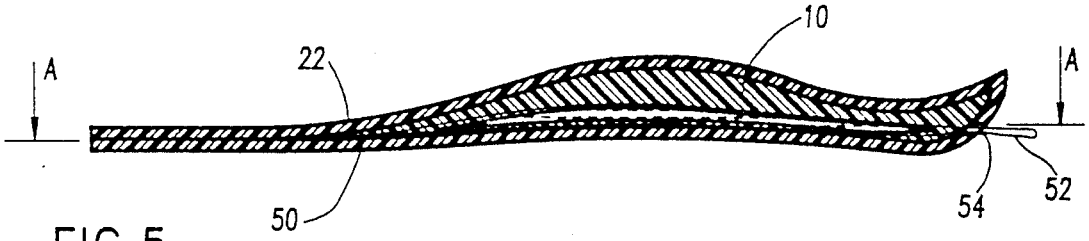
FIG. 5 is a sectional illustration of a further type of insole constructed and operative in accordance with the present invention.
Figure 6:
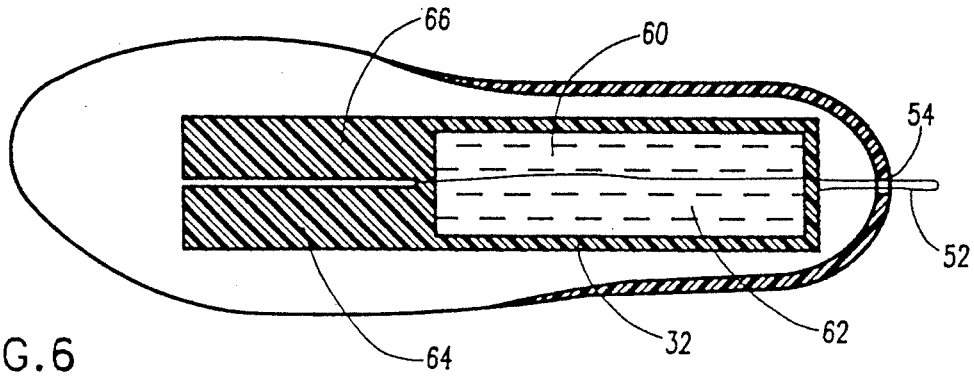
FIG. 6 is a sectional illustration of the insole of FIG. 5 taken along the lines A—A in FIG. 5.

Reference is now made to FIGS. 5 and 6, which illustrate an alternative embodiment of the present invention wherein an opening in container 32 is produced by pulling a string 52. Container 32, as shown in FIG. 6, may comprise a compartment 60 containing a curing agent 62 and extensions 64 and 66 maintained between top layer 22 and a bottom layer 50. String 52 is wrapped around container 32 and one end of the string is sealingly positioned between extensions 64 and 66, while the other end protrudes from the insole housing though a hole 54. Pulling the protruding portion of string 52 ruptures container 32, allowing curing agent 62 to come into contact with the uncured resin, which in turn impregnates the deformable foam 10.

Figure 7:
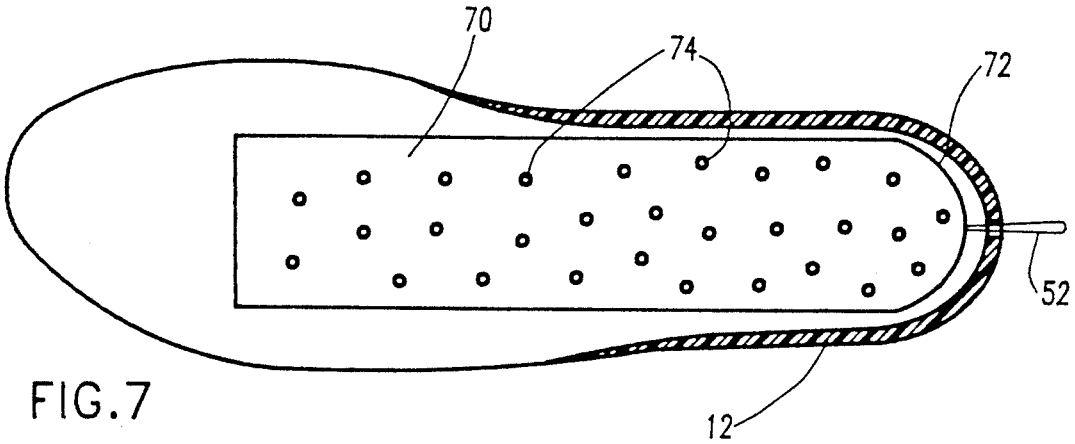
FIG. 7 is a sectional illustration of the insole, depicting an upper layer of an external container.

According to a further alternative embodiment of this invention, as shown in FIG. 7, container 32 and the string 52 are contained within another external container 70 comprising an open end 72 and an upper layer which is perforated by holes 74. An example of the external container 70 is a 0.002 polyethylene film pouch.

So as to eliminate the contact of string 52 with the resin which impregnates deformable material 10, string 52 extends outside the container 70 and the insole housing 12. Open end 72 is heat sealed onto string 52, permitting it to be pulled and thus, to cause container 32 to rupture. After container 32 is ruptured, the curing agent 62, contained in container 32, fills external container 70. As the foot engages the insole, the pressure of the foot on the insole causes the curing agent 62 to flow out of the holes of the upper layer of the external container 70.

Figure 8:
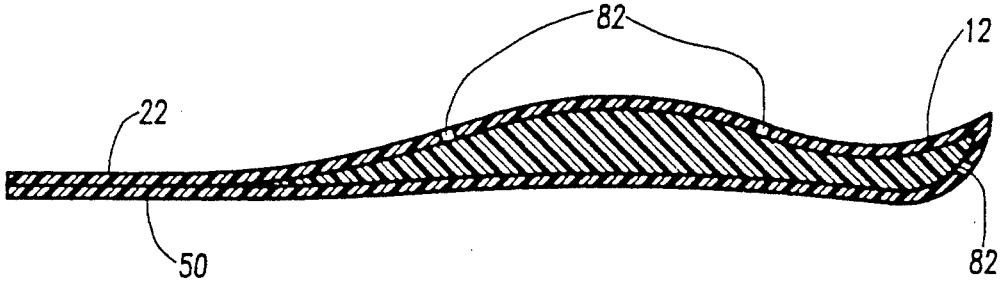
FIG. 8 is a sectional illustration of yet another type of insole constructed and operative in accordance with the present invention.

Reference is now made to FIG. 8, which illustrates an insole constructed and operative in accordance with an alternative embodiment of the present invention. At least one opening is defined in the insole housing 12. This opening may be defined by apertures 82 in the top layer 22, and/or in the bottom layer 50 or in predetermined gaps (not shown) between the bottom layer 50 and the top layer 22.

The opening or openings in the insole housing 12 enable excess resin or gas, generated by the chemical curing reaction, to escape from the interior of the insole housing, thus eliminating the build up of excessive pressure under the foot during the molding process which might adversely affect the shape of the finished insole.

According to a preferred embodiment of the present invention, the aperture or apertures 82 may be sealed with a material which is permeable to gas but impermeable to liquid. This permits the escape of any air, or gases produced by the curing process, which may have become trapped inside the insole housing, thus eliminating the build up of excessive pressure beneath the foot.

According to an alternative embodiment of the present invention, apertures 82 enable communication of air between the exterior and interior of the insole housing, allowing contact of the water vapor contained in the air with the uncured resin, for moisture curing thereof.

According to a further alternative embodiment of the present invention, apertures 82 allow foot perspiration to penetrate the insole housing, allowing it to cure the impregnated material.

According to an alternative embodiment of the invention, the insole housing 12, containing deformable material which is impregnated with an uncured resin, is stored in a moisture barrier container, so as to eliminate exposure of the uncured resin to air and moisture and thus prevent unintended curing during storage. An example of a material useful in the construction of such a moisture barrier container is a three layer laminate comprising a 0.002 inch polypropylene film, a 0.0005 inch aluminum foil and a 0.002 inch polypropylene film.

According to a preferred embodiment of the present invention, the insole housing can be located on a flat surface, on a special mold, or inside a shoe before the step of locating the foot on the insole.

It will be appreciated by persons skilled in the art that the present invention is not limited by what has been particularly shown and described hereinabove. Rather the scope of the present invention is defined only by the claims which follow:

What is claimed is:

1. A method for producing an insole for a foot having a given contour and arch height and comprising the following steps:

defining an insole housing in which is disposed a predetermined amount of an uncured expandable resin irrespective of the given contour and arch height;

introducing a curing agent into said insole housing to activate said resin and to start curing thereof;

locating the foot on said insole housing;

allowing said resin, when activated, to expand within said insole housing so as to conform to the given contour and arch height;

allowing said resin to harden and to preserve the configuration defined by the bottom of the foot.

2. Apparatus for producing a custom made insole for a foot having a given contour and arch height and comprising:

an insole housing having a selectable shape;

a predetermined amount of an expandable, uncured resin located within said insole housing irrespective of the given contour and arch height; and means for introducing a curing agent into said insole housing to activate said resin and cause it to expand so as to conform to the given contour and arch height and harden within said insole housing.

3. Apparatus according to claim 2 and wherein said insole housing is selectably locatable in a shoe.

4. Apparatus according to claim 2 and wherein said insole is integrally formed with a shoe.

5. A method according to claim 1 and wherein said resin comprises a moisture cured prepolymer polyurethane.

6. A method according to claim 1 and also comprising the step of storing said insole housing in a moisture impermeable storage enclosure.

7. A method according to claim 1 and also comprising the step of defining at least one opening in said insole housing, for allowing resin curing reaction products to escape therethrough.

8. A method according to claim 1 and wherein said resin comprises polyurethane resin.

9. A method according to claim 1 and also comprising the step of inserting said insole into a shoe.

10. A method according to claim 1 and wherein said step of defining comprises the step of integrally forming said insole within a shoe.

11. A method according to claim 1 and wherein said curing agent comprises a protic compound.

12. A method according to claim 1 and wherein said insole housing comprises a deformable material comprising reticulated polyurethane foam.

13. A method according to claim 12 and wherein said resin, when activated, expands into spaces defined by cells of said deformable material.

* * * * *